United States Patent [19]

Fehrer

[11] 4,038,728

[45] Aug. 2, 1977

[54] NEEDLING MACHINE FOR MANUFACTURING ENDLESS FIBROUS WEBS

[76] Inventor: Ernst Fehrer, Auf der Gugl 28, Linz, Austria

[21] Appl. No.: 735,015

[22] Filed: Oct. 22, 1976

Related U.S. Application Data

[63] Continuation-in-part of Ser. No. 661,745, Feb. 26, 1976, abandoned.

[30] Foreign Application Priority Data

Apr. 3, 1975 Austria ..... 2543/75

[51] Int. Cl.[2] ..... D04H 18/00

[52] U.S. Cl. ..... 28/110; 28/111

[58] Field of Search ..... 28/4 R, 110, 111

[56] References Cited

U.S. PATENT DOCUMENTS

| | | | |
|---|---|---|---|
| 3,117,359 | 1/1964 | O'Byrne | 28/4 R |
| 3,129,486 | 4/1964 | O'Byrne | 28/4 R |
| 3,488,820 | 1/1970 | Fehrer | 28/4 R |
| 3,540,096 | 11/1970 | Porta | 28/4 R |
| 3,555,638 | 1/1971 | O'Byrne | 28/4 R |
| 3,727,277 | 4/1973 | Rust, Jr. | 28/4 R |
| 3,810,284 | 5/1974 | Brochetti | 28/4 R |
| 3,813,741 | 6/1974 | Brochetti | 28/4 R |

FOREIGN PATENT DOCUMENTS

| | | | |
|---|---|---|---|
| 113,116 | 5/1941 | Australia | 28/111 |

*Primary Examiner*—Robert R. Mackey
*Attorney, Agent, or Firm*—Kurt Kelman

[57] ABSTRACT

A perforated table is pivoted on a vertical axis to a machine frame on one side thereof. An upper set of juxtaposed, closely spaced needling units is arranged over the table in a transverse row. A perforated stripper is disposed between the upper set of needling units and the table. A lower set of juxtaposed, closely spaced needling units is secured to the table and arranged on the underside thereof in a transverse row. Each row of needling units has the same length, which defines the working width of the machine.Drive means for operating the needling units of the upper and lower sets in unison are provided and comprise flexible couplings between adjacent needling units in each set. Each needling unit is provided on the underside with needles and operable by the drive means to move the needles up and down. The needles of the upper set of needling units are operable to penetrate through the stripper and from the outside through an endless fibrous web which lies on the table and extends across the row of needling units of the upper set. The needles of the lower set of needling units are operable to penetrate from the inside through the fibrous web when the same extends around one end of the table and on the underside thereof and across the row of the needling units of the lower set toward the opposite end of the table.

4 Claims, 3 Drawing Figures

FIG. 1
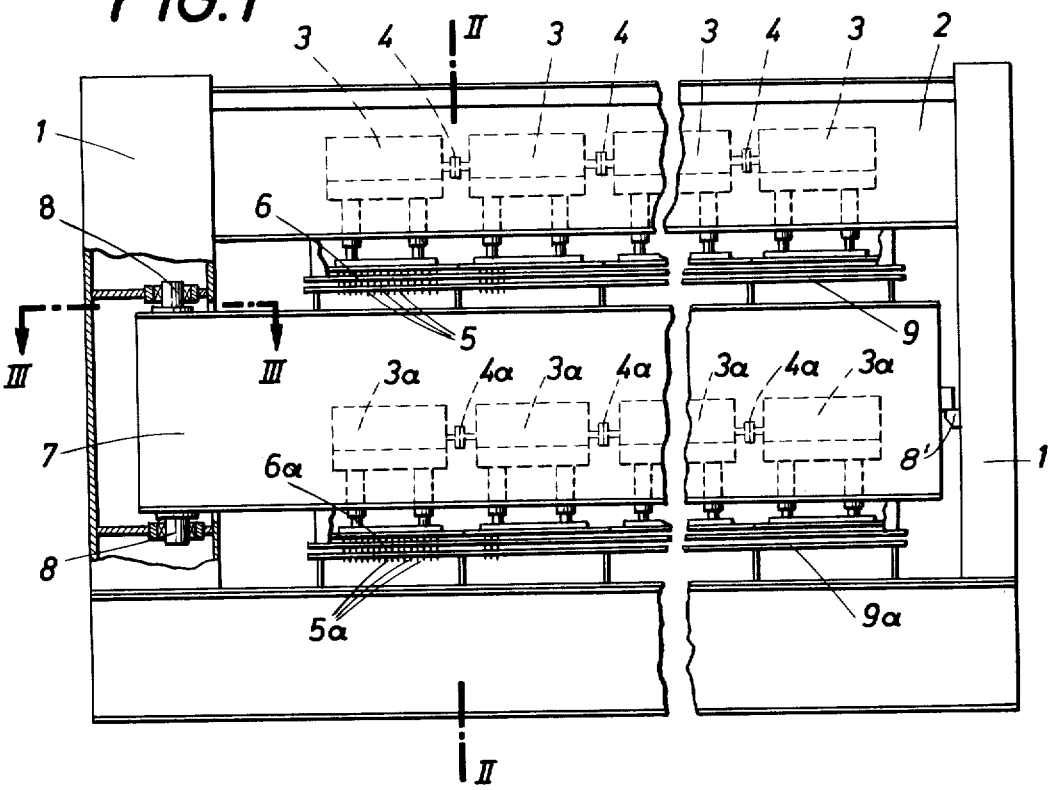
FIG. 2
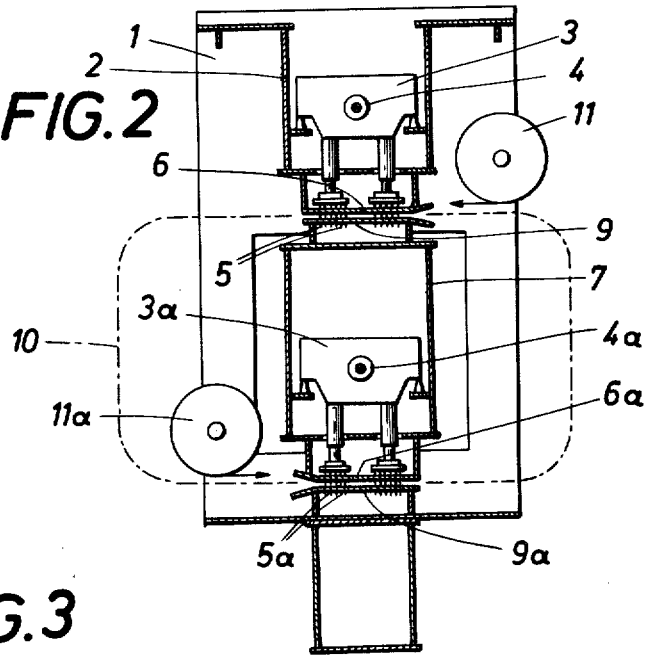
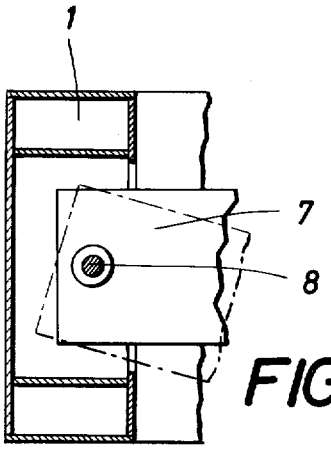
FIG. 3

NEEDLING MACHINE FOR MANUFACTURING ENDLESS FIBROUS WEBS

This is a continuation-in-part application of my copending application Ser. No. 661,745, filed Feb. 26, 1976, now abandoned.

This invention relates to a needling machine for manufacturing endless fibrous webs comprising a plurality of juxtaposed needling units which are mounted in the machine frame in a row extending the working width of the machine and are jointly driven by means of flexible couplings, a perforated stripper for the needles moving up and down, and a perforated table which constitutes a support for the fibrous web and is pivoted on a vertical axis on one side of the machine frame and is releasably locked on the other side of the frame, in which machine the fibrous web is moved between the support and the stripper and at the end opposite to the receiving end is moved downwardly and under the table back to the receiving end.

Such machines are known from my U.S. Pat. No. 3,488,820. In such machines, the table can be unlocked and be pivotally moved out of the machine frame so that the completed fibrous web can be pulled off at the free end of the table or an endless reinforcing fabric can be applied to the table. Endless fibrous webs are mainly required as so-called needled felts for paper machines, in which they constitute a support for the fibrous sheet. Whereas in the known machine the fibrous web can be needled only from one side, paper machine felts are known which comprise a woven fabric as a backing core and fibrous layers which have been needled to the core on both sides. It is not difficult to needle a fibrous layer to a backing on one side thereof with the known machine. When this has been accomplished and the fibrous layer desired on the other side of the woven backing is to be needled to the latter, the entire endless web must be turned inside out. This operation is relatively complicated and timeconsuming and substantially adds to the manufacturing costs. For other purposes it is also sometimes necessary or desirable to needle an endless fibrous web from both sides.

It is an object of the invention so to improve the needling machine described first hereinbefore that endless fibrous webs needled from both sides can be made in one operation and without need for turning the structure inside out.

This object is accomplished according to the invention by arranging a second set of needling units in a row in the table to needle that course of the fibrous web which moves under the table.

Whereas the needles of the needling units disposed above the table penetrate the endless fibrous web from the outside, the lower course of the fibrous web is needled from the inside by the needling units in the table so that the web is needled from both sides and fibrous layers can be needled to both sides of a woven fabric used as a backing core. This needling of both layers to the backing is effected simultaneously in a single operation, and the endless web need not be turned inside out. As the needling units comprise a closed gear housing, which is filled with a suitable lubricant, they hardly require maintenance. This is essential, because the needling units in the machine table are accessible only wih difficulty. Because all needling units employed may be identical, the manufacture is simplified and the manufacturing and purchasing costs are reduced. The machine according to the invention may constitute a modular system having any desired working width because the comparatively simple machine frame can be so designed that the number of juxtaposed needling units in the upper and lower sets may be increased or decreased.

Whereas a needling machine is known (Swiss Pat. No. 444,108) in which a plurality of needle boards are arranged one over the other in a common machine frame and are used for needling one and the same web, the web moves through that machine along an approximately zigzag-shaped path, the needle boards are arranged in pairs, and the needle boards of each pair penetrate one and the same portion of the web from above and below, respectively. For this reason, the machine cannot be used to needle endless fibrous webs. Besides, the needle boards are secured to rocker arms and extend throughout the width of the web. As a result, the width of the web is limited by structural considerations and will in no case be sufficient for endless needled felts for paper machines.

An embodiment of the invention is shown strictly diagrammatically and by way of example in the accompanying drawing in which FIG. 1 shows a needling machine in front elevational view, with a portion in section;

FIG. 2 is a sectional view along line II—II of FIG. 1; and

FIG. 3 is a horizontal section along line III—III of FIG. 1.

A machine frame comprises side frames 1 which are connected by a box-shaped upper beam 2, in which needling units 3 are mounted, which extend throughout the working width and are jointly driven by means of flexible couplings 4. A perforated stripper 6 is affixed to machine frame beam 2 and needles 5 move up and down through stripper 6. A table 7 is pivoted on vertical pivots 8 in one side frame 1 and is releasably locked at 8' to the other side of the frame. The table carries perforated support 9 for pivoting therewith.

As is seen in FIG. 3, upon releasing the lock at 8', table 7 may be sufficiently pivoted about vertical pivots 8, 8 out of the machine frame 1, 2 to enable an endless fibrous web to be placed for support on the table or to remove a needled web from the table over the free table end opposite the pivoted end of the table. As shown in FIG. 2, the table carries perforated web support 9 through which needles 5 of upper needling units 3 pass during the needling operation and is affixed to the table for pivoting therewith. A fibrous web is moved between support 9 and stripper 6 and at the discharge end is moved downwardly and under table 7 back to the receiving end.

According to the invention, table 7 is hollow and accomodates a second set of needling units **3*a* which are arranged in a row and are also driven jointly by flexible couplings 4*a* and carry needle boards provided with needles 5*a*. A stripper 6*a* is associated with the lower needling units 3*a*. A perforated support 9*a* is disposed below the stripper 6*a* and is secured to the base of the machine frame. The lower needling units 3*a* needle the lower course of the fibrous web from the inside. Above table 7**, the fibrous web is needled from the outside.

FIG. 2 shows in dotted lines an endless web 10 to which fibrous layers are to be needled on both sides. The fibers are supplied as non-woven webs from two reels **11, 11*a*. The reel 11*a* is disposed within web 10 so that the non-woven web supplied by the reel 11*a* is laminated on the inside of the web. After the fibers in the form of non-woven webs have been delivered to endless web 10, i.e. when reels 11 and 11***a* are empty, the reels are removed from the machine frame whereon they are removably mounted, table 7 is pivoted to permit removal of the needled web, and full reels are mounted on the machine frame again for the next needling operation.

What I claim is:

1. A needling machine for manufacturing endless fibrous webs, comprising a. a machine frame, b. a perforated table pivoted on a vertical axis to the machine frame on one side thereof, c. an upper set of juxtaposed, closely spaced needling units arranged over the table in a transverse row, d. a perforated stripper disposed between said upper set of needling units and said table, e. a lower set of juxtaposed, closely spaced needling units secured to said table and arranged on the underside thereof in a transverse row, f. each of said rows of needling units of said upper and lower sets having the same length defining the working width of the machine, and g. drive means for operating said needling units of each of said upper and lower sets in unison, said drive means comprising flexible couplings between adjacent needling units in each set, 1. each of said needling units being provided on the underside with needles and operable by said drive means to move said needles up an down, 2. said needles of said upper set of needling units being operable to penetrate through said stripper and from the outside through a fibrous web which lies on said table and extends across said row of needling units of said upper set, and 3. said needles of said lower set of needling units being operable to penetrate from the inside through said fibrous web when the same extends around one end of said table and on the underside thereof and across said row of the needling units of said lower set toward the opposite end of said table.

2. A needling machine as set forth in claim 1, which comprises locking means for releasably locking said table to said machine frame on the other side thereof.

3. A needling machine as set forth in claim 1, in which said table constitutes a box structure wherein said lower set of needling units is mounted.

4. A needling machine as set forth in claim 1, which comprises perforated web-supporting means adapted to support said fibrous web under said lower set of needling units and a second perforated stripper disposed between said lower set of needling units and said web-supporting means.

* * * * *